US010329700B2

(12) United States Patent
Xu et al.

(10) Patent No.: US 10,329,700 B2
(45) Date of Patent: Jun. 25, 2019

(54) METHOD FOR PRODUCING A FLUFFY TEMPERATURE REGULATING WARMTH RETENTION MATERIAL AND FLUFFY TEMPERATURE REGULATING WARMTH RETENTION MATERIAL

(71) Applicant: 3M INNOVATIVE PROPERTIES COMPANY, St. Paul, MN (US)

(72) Inventors: Feng Xu, Shanghai (CN); Guo Tong Zhao, Shanghai (CN); Xiaoshuan Fu, Shanghai (CN); Hong Bing Xiang, Shanghai (CN); Yue Ge, Beijing (CN)

(73) Assignee: 3M Innovative Properties Company, St. Paul, MN (US)

( * ) Notice: Subject to any disclaimer, the term of this patent is extended or adjusted under 35 U.S.C. 154(b) by 407 days.

(21) Appl. No.: 15/030,717

(22) PCT Filed: Oct. 30, 2014

(86) PCT No.: PCT/US2014/063088

§ 371 (c)(1),
(2) Date: Apr. 20, 2016

(87) PCT Pub. No.: WO2015/066284

PCT Pub. Date: May 7, 2015

(65) Prior Publication Data

US 2016/0273139 A1 Sep. 22, 2016

(30) Foreign Application Priority Data

Oct. 30, 2013 (CN) ..... 2013 1 0526669

(51) Int. Cl.
*D04H 1/02* (2006.01)
*D04H 1/413* (2012.01)
(Continued)

(52) U.S. Cl.
CPC ..... *D04H 1/02* (2013.01); *D04H 1/413* (2013.01); *D04H 1/541* (2013.01); *D04H 1/593* (2013.01)

(58) Field of Classification Search
CPC ..... D04H 1/02; D04H 1/413; D04H 1/514; D04H 1/593
See application file for complete search history.

(56) References Cited

U.S. PATENT DOCUMENTS 6,077,597 A 6/2000 Pause
7,244,497 B2 * 7/2007 Hartmann ..... D01F 1/10 428/373
2008/0120761 A1 5/2008 Yang

FOREIGN PATENT DOCUMENTS

CN 1174264 2/1998
CN 101260617 9/2008
(Continued)

OTHER PUBLICATIONS

International Search Report for PCT International Application No. PCT/US2014/063088 dated Jan. 30, 2015, 4 pages.

*Primary Examiner* — Cephia D Toomer

(57) ABSTRACT

A method for producing a fluffy temperature regulating warmth retention material and the fluffy temperature regulating warmth retention material produced therefrom are disclosed. The method comprises: selecting a low melting point fiber and an additional fiber; carding to form a single web; spray coating a phase change material along at least part of the length of a surface of the single web; lapping layer by layer of the single web; and performing a heat setting reinforcement to form the warmth retention material. According to the present invention, a fluffy temperature regulating warmth retention material comprising an appropriate ratio of a phase change material may be obtained and the material exhibits a satisfactory temperature regulating
(Continued)

effect, and meanwhile, it can maintain, to the full extent, or is close to, the original filling power and soft hand feeling where no phase change material is incorporated. In addition, the phase change material can be retained very well within the fluffy temperature regulating warmth retention material and thus has a wash resistance property.

20 Claims, 2 Drawing Sheets

(51) Int. Cl.
*D04H 1/541* (2012.01)
*D04H 1/593* (2012.01)

(56) References Cited

FOREIGN PATENT DOCUMENTS

| | | |
|---|---|---|
| CN | 201567497 | 9/2010 |
| CN | 102425038 | 4/2012 |
| CN | 102561027 | 7/2012 |
| CN | 102587150 | 7/2012 |
| CN | 102677396 | 9/2012 |
| EP | 1614653 | 1/2006 |
| WO | WO 2002-12607 | 2/2002 |
| WO | WO 2005-020735 | 3/2005 |

* cited by examiner

METHOD FOR PRODUCING A FLUFFY TEMPERATURE REGULATING WARMTH RETENTION MATERIAL AND FLUFFY TEMPERATURE REGULATING WARMTH RETENTION MATERIAL

TECHNICAL FIELD OF THE INVENTION

The present invention relates to a temperature regulating warmth retention material. In particular, the present invention relates to a method for producing a fluffy temperature regulating warmth retention material and the fluffy temperature regulating warmth retention material produced therefrom.

BACKGROUND ART

Common warmth retention materials available from the market include primarily natural *flocculus* (including cotton, wool, feather, and the like) and synthetic *flocculus* (primarily synthetic fiber *flocculus*). The principle of warmth retention of such *flocculus* is to retain still air as more as possible thereby preventing or isolating the flow of heat. Accordingly, a warmth retention material is required to have, or to be form as, a fluffy structure.

A warmth retention material comprises a phase change material incorporated therein to achieve temperature regulation of the object that is kept warm, wherein the phase change material may be distributed on the top and bottom surfaces of the warmth retention material, or entered the same with a decreasing gradient. On one hand, a high content of the phase change material results in a good temperature regulating effect, but it may make the warmth material harder in hand feeling. Meanwhile, the thickness of the material would also decrease, which would affect the filling power of the same. On the other hand, in order to impart wash resistance, the phase change material is typically applied to, or retained within the warmth retention material by dipping, or drawing and stretching in combination with surface spray coating and secured by hydroentangling, needle punching, or the like. These processes for incorporating a phase change material and securing the warmth retention material, i.e. dipping, drawing, hydroentangling and needle punching, would make the warmth retention material become dense and thinner, and the filling power of the same would decrease and the hand feeling would be harder as compared with the warmth retention material that is not incorporated with the phase change material. Therefore, when this warmth retention material is used in garments, bedding articles, it needs to be improved. Chinese patent application publication CN 102561027 A discloses a *flocculus* with smart temperature regulating function and a method for preparing the same. According to the description, a *flocculus* with smart temperature regulating function is formed by combination of a phase change material and a *flocculus* substrate by padding, soaking for water absorption, spray coating and sprinkling, spray coating, among others, wherein the method comprises mixing the stock fibers, carding the mixed fibers, lapping to form a fiber web, drawing and stretching the fiber web, and spray coating onto both surfaces of the fiber web with a mixture solution of the phase change material and an adhesive.

Chinese patent application publication CN 102587150 A discloses a method of producing an energy storage nonwoven fabric fiberfill. According to the description, the method comprises (by following the basic manufacturing process of a melt-blown non-woven fabric): using a high polymer raw material for producing the non-woven fabric as the principal raw material and mixing a phase change microcapsule with a UV curable resin in a certain ratio; spray coating the mixture onto the surfaces of the thin non-woven layer; curing; placing the resulting non-woven fabric on web forming curtain; repeating blowing decomposition to thicken the non-woven fabric; and securing by hydroentangling, needle punching, heat punching, and the like to form the energy storage nonwoven fabric fiberfill.

Apparently, with respect to such warmth retention materials, there are still some problems in incorporating sufficient phase change material into a warmth retention material and keeping it securely therein, and thus providing a desired temperature regulating performance and wash resistance, as well as retaining a sufficient filling power and good hand feeling, and such problems need to be addressed.

SUMMARY OF THE INVENTION

The objective of the present invention is to provide a method for producing a fluffy temperature regulating warmth retention material and the fluffy temperature regulating warmth retention material produced therefrom.

As an aspect of the present invention, a method for producing a fluffy temperature regulating warmth retention material is provided. The method comprises: selecting a low melting point fiber and an additional fiber; carding to form a single web; spray coating a phase change material along at least a portion of the length of the single web; lapping layer by layer the single web; and performing a heat setting securing to form the warmth retention material.

Preferably, in the method for producing a fluffy temperature regulating warmth retention material of the present invention, the low melting point fiber is 6% to 20% (weight percentage, the same below) of the total fiber.

Preferably, in the method for producing a fluffy temperature regulating warmth retention material of the present invention, the low melting point fiber is selected from a terylene low melting point fiber, a polypropylene low melting point fiber or a polyethylene low melting point fiber.

Preferably, in the method for producing a fluffy temperature regulating warmth retention material of the present invention, the low melting point fiber is selected from one of a skin-core type low melting point fiber, or a parallel type low melting point fiber.

Preferably, in the method for producing a fluffy temperature regulating warmth retention material of the present invention, the additional fiber is selected from one or more of a natural fiber, a synthetic fiber, or a regenerated fiber.

Preferably, in the method for producing a fluffy temperature regulating warmth retention material of the present invention, a phase change material having a net content of 10% to 55% of the total weight of the temperature regulating warmth retention material is spray coated on a surface of the single web.

Preferably, in the method for producing a fluffy temperature regulating warmth retention material of the present invention, the phase change material is spray coated at an interval of the same distance or at an interval of different distances along the length direction of the surface of the single web.

Preferably, in the method for producing a fluffy temperature regulating warmth retention material of the present invention, the phase change material is spray coated along the length of the surface of the single web in a consecutive manner.

Preferably, the method for producing a fluffy temperature regulating warmth retention material of the present invention comprises a step of preheating the single web after the phase change material is spray coated along at least part of the length of the surface of the single web.

Preferably, in the method for producing a fluffy temperature regulating warmth retention material of the present invention, the preheating is performed at a temperature of 60° C. to 80° C. (Celsius degree, the same below), for 5 to 15 s (Second, the same below).

Preferably, in the method for producing a fluffy temperature regulating warmth retention material of the present invention, the single web is lapped layer by layer by cross lapping.

Preferably, in the method for producing a fluffy temperature regulating warmth retention material of the present invention, two single web which are not spray coated with the phase change material are lapped layer by layer with at least one single web which is spray coated with the phase change material, and the single web which is spray coated with the phase change material is placed in the middle.

Preferably, in the method for producing a fluffy temperature regulating warmth retention material of the present invention, the heat setting securing comprises performing a step of spray coating a glue on the outer surfaces of the *flocculus* formed by lapping layer by layer of the single web, and drying the same.

Preferably, in the method for producing a fluffy temperature regulating warmth retention material of the present invention, a glue selected from one of an acrylic copolymer emulsion, a polyvinyl acetate emulsion, and a vinyl acetate-acrylic copolymer emulsion is used in the step of spray coating a glue, and the solid content of the glue spray coated is 2 to 15 grams per square meter (hereafter "gsm").

Preferably, in the method for producing a fluffy temperature regulating warmth retention material of the present invention, the drying step is performed at a temperature of 130° C. to 150° C. for 5 to 15 minutes (hereafter "min").

As another aspect of the present invention, a fluffy temperature regulating warmth retention material produced according to the method of the present invention is provided. The fluffy temperature regulating warmth retention material comprises multiple single web layers which are lapped layer by layer, wherein the surfaces of at least part of the multiple single web layers are spray coated with a phase change material, and the at least part of the multiple single web layers comprises a low melting point fiber and an additional fiber.

Preferably, in the fluffy temperature regulating warmth retention material produced according to the method of the present invention, the low melting point fiber is 6% to 20% of the total weight of the fiber.

Preferably, in the fluffy temperature regulating warmth retention material produced according to the method of the present invention, the low melting point fiber is selected from a terylene low melting point fiber, a polypropylene low melting point fiber or a polyethylene low melting point fiber.

Preferably, in the fluffy temperature regulating warmth retention material produced according to the method of the present invention, the low melting point fiber comprises a skin-core type low melting point fiber.

Preferably, in the fluffy temperature regulating warmth retention material produced according to the method of the present invention, the low melting point fiber is of a gauge in a range of 1.5 to 7 Denier (a fiber fineness unit, hereafter "D").

Preferably, in the fluffy temperature regulating warmth retention material produced according to the method of the present invention, the additional fiber is selected from one or more of a natural fiber, a synthetic fiber, or a regenerated fiber.

Preferably, in the fluffy temperature regulating warmth retention material produced according to the method of the present invention, the phase change material is a phase change microcapsule, and the core material of the phase change microcapsule is selected from one or more of a paraffin, an n-alkane compound, a halogenated n-alkane compound or an aliphatic ester, or a mixture of several of them.

Preferably, in the fluffy temperature regulating warmth retention material produced according to the method of the present invention, the phase change material has a weight of 10% to 55% of the total weight of the temperature regulating warmth retention material.

Preferably, in the fluffy temperature regulating warmth retention material produced according to the method of the present invention, the phase change material has a weight of 25% to 50% of the total weight of the temperature regulating warmth retention material.

Preferably, in the fluffy temperature regulating warmth retention material produced according to the method of the present invention, the phase change material is spray coated on a surface of each of the single web layer.

Preferably, in the fluffy temperature regulating warmth retention material produced according to the method of the present invention, the phase change material is spray coated on a surface of every two single web layers.

Preferably, in the fluffy temperature regulating warmth retention material produced according to the method of the present invention, the phase change material is spray coated on a surface of the single web in the middle portion.

Preferably, in the fluffy temperature regulating warmth retention material produced according to the method of the present invention, a glue is spray coated onto the outer surfaces of the fluffy temperature regulating warmth retention material at a net content level of 2 gsm to 15 gsm.

Preferably, in the fluffy temperature regulating warmth retention material produced according to the method of the present invention, the outer surfaces of the fluffy temperature regulating warmth retention material is spray coated with a glue selected from one of an acrylic copolymer emulsion, a polyvinyl acetate emulsion, and a vinyl acetate-acrylic copolymer emulsion.

According to the present invention, a method for producing a fluffy temperature regulating warmth retention material and the fluffy temperature regulating warmth retention material produced in accordance with the method can be provided, wherein the phase change material may be selectively distributed on certain several layers or each layer of the single web, which can upload an appropriate ratio, or more, of the phase change material. The present invention exhibits an apparent temperature regulating function.

According to the present invention, a low melting point fiber material may be used, and the outer surfaces of the *flocculus* formed upon completion of the lapping layer by layer of the single web may be spray coated with a glue and then dried to secure by adhesion the phase change material more firmly within the warmth retention material with the assisting cohesive action of the low melting point fibers and the spray coated glue, thereby eliminating the necessity of employing the conventional dipping, drawing, hydroentangling, and needle punching processes.

Therefore, according to the present invention, a fluffy temperature regulating warmth retention material comprising an appropriate ratio of a phase change material may be obtained and the warmth retention material exhibits a satisfactory temperature regulating effect, and meanwhile, it can retain, to the full extent, or is close to, the original filling power and soft hand feeling where no phase change material is incorporated. In addition, the phase change material can be retained very well within the fluffy temperature regulating warmth retention material and thus the material has a wash resistance property. Furthermore, various fibers may be selected to form the fluffy temperature regulating warmth retention material such that the present invention can be widely used, such as for example, in various garments, shoes and hats, and bedding products.

Figure 1:
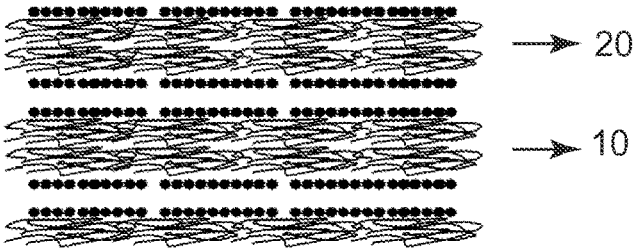
FIG. 1 is a schematic diagram of the fluffy temperature regulating warmth retention material produced in accordance to the first Example of the method of the present invention.

The present invention will be described in more detail by particular examples in combination with the accompanying drawings. The accompanying drawings are merely schematic and not drawn to scale, and the examples are merely exemplary and should not be interpreted as limiting the scope of the present invention.

DETAILED DESCRIPTION OF THE INVENTION

According to an aspect of present invention, a method for producing a fluffy temperature regulating warmth retention material is provided. The method comprises: selecting a low melting point fiber and an additional fiber, such as for example, one or more of various natural fibers, or synthetic fibers, or regenerated fibers; treating conventionally the fibers selected by mixing, opening and cotton feeding; then carding and forming a single web; spray coating a phase change material along at least a part of the length of the single web; then lapping layer by layer the single web to form a *flocculus*; and heat setting to reinforce the *flocculus* to form the warmth retention material.

According to the method of the present invention, the low melting point fiber refers to a fiber having a melting point that is lower than 150° C. The melting points of currently available low melting point fibers are in a range of 110° C. to 130° C. The low melting point fiber may be selected from one or more of a terylene low melting point fiber, a polypropylene low melting point fiber or a polyethylene low melting point fiber, and may be 6% to 20% of the total weight of the fiber. The gauge of the low melting point fiber may be 1.5 D to 7 D, and the length of the same is preferably from 38 mm to 64 mm. The remaining additional fiber, which is 80% to 94%, may use a natural fiber such as a cotton fiber, a wool fiber, and the like; or a synthetic fiber such as a terylene fiber, a polypropylene fiber, an acrylic fiber, and the like; or a regenerated fiber such as a viscose fiber, and the like. Any one of the listed fiber may be used alone, or a mixture of two or more fibers from the same type or different types may be used.

According to the present invention, after the fibers are subjected to carding and formed into a single web, a phase change material is spray coated onto the surface of the single web, which can be achieved by a method of spray coating a phase change microcapsule emulsion. A conventional phase change microcapsule emulsion product comprises a phase change microcapsule as the phase change material and its content is from 15% to 50%, and the remaining comprises water, an emulsifier, a crosslinking agent, a dispersing agent, etc., wherein the size of the microcapsule is in a range of 0.1 to 50 microns. Commercially available phase change microcapsule emulsion products comprise, for example, Standard-22% phase change microcapsule emulsion produced by Shenzhen Yingbao Development Co., Ltd, among others. In this invention, a certain amount of phase change microcapsule emulsion is spray coated such that, in the obtained temperature regulating warmth retention material, the net content of the phase change microcapsules is from 10% to 55% of the total weight of the temperature regulating warmth retention material, or preferably, from 25% to 50%, which is better.

The phase change material may be spray coated for a certain length along the web surface, and this may be repeated with an interval having the same length or different lengths. Alternatively, the phase change material may be spray coated in a continuous manner along the length of the single web surface. Preferably, the certain length along the surface of the single web that is spray coated with the phase change material is determined in accordance with the predetermined width of the temperature regulating warmth material, such as for example, being equal to the width, or two or several times of the width.

Preferably, a pre-drying for 5 to 15 seconds is performed upon completion of the spray coating. The temperature for the pre-drying is from 60° C. to 80° C. to facilitate retention of the phase change material during the process.

Next, the single web is lapped layer by layer and this can be carried out by a conventional cross lapping technique, i.e. the single web are driven by a lapping machine moving back and forth to fold and lap layer by layer the single web in the width direction of the lapping machine onto a web delivery curtain moving at a certain speed, thereby forming a *flocculus* with a certain thickness. Generally, the lapping is performed in accordance with the breadth of the lapping machine. In other words, the breadth of the lapping machine will determine the width of the *flocculus* thus formed. For the single web layers lapped in this manner, at least part of the single web layers is spray coated with the phase change material. For example, where the spray coating of the phase change material is performed along the length direction of the single web with a length determined by the breadth of the lapping machine, and repeated at an interval of the same length, and then the folding and lapping of the layers of the cross lapping is performed in accordance with the breadth of the lapping machine, the *flocculus* obtained from the cross lapping would be one formed by lapping of multiple single web layers wherein one of every two single web layers is spray coated with the phase change material. Where the spray coating is performed in a continuous manner, the *flocculus* obtained from the cross lapping would be one formed by lapping of multiple single web layers wherein each single web layer is spray coated with the phase change material. In this case, based on the direction of the cross lapping, such as for example, with respect to a back and forth folded lapping, the surfaces of the single web layers which are spray coated with the phase change material will be opposite to each other, i.e. they are lapped in a face-to-face manner; where the lapping is performed in the same direction, then the surfaces of each single web layer which are spray coated with the phase change material are facing the same direction, i.e. the surface of the single web which is spray coated with the phase change material is lapped directly with the surface of another single web which is not spray coated with the phase change material.

Apparently, a *flocculus* having a layer or several selected layers spray coated with the phase change material may be formed by adjusting the length and the period of time of spray coating the phase change material along the surface of the single web, and the manner of cross lapping. For example, a *flocculus* with only several middle single web layers being spray coated with the phase change material may be formed.

Alternatively, a *flocculus* with only several selected layers spray coated with the phase change material may also be formed by cross lapping a single web which is spray coated with a continuous phase change material and two or at least two single webs which are not spray coated with the phase change material. For example, a *flocculus* with only several middle single web layers being spray coated with the phase change material may be obtained by placing the single web spray coated with the phase change material on its surface in the middle.

A glue spray coating and drying step may be performed for heat setting reinforcement of the *flocculus* obtained by cross lapping. The glue spray coating is performed on the outer surfaces of the *flocculus* to obtain a solid content of 2 gsm to 15 gsm, and the glue may be one of the following: an acrylic copolymer emulsion, a polyvinyl acetate emulsion, or a vinyl acetate-acrylic copolymer emulsion. Then, the drying is performed at a temperature of 130° C. to 150° C. for 5 to 15 minutes to achieve a fluffy temperature regulating warmth retention material.

For carrying out the method of the present invention, with respect to the existing non-woven carding and cross lapping process, a spray coating device and a pre-drying device may be incorporated between the carding machine and the cross lapping machine to achieve spray coating of the phase change material and pre-drying. Additionally, a glue spray coating device and a drying device may be provided after the cross lapping machine to achieve glue spray coating and drying of the *flocculus*. Such arrangements can be achieved by using the prior art. In this way, a more complete process, which comprises the existing process and the method of the present invention, for producing a fluffy temperature regulating warmth retention material from fibers, can be listed as below:

Selecting a low melting point fiber and an additional fiber—mixing the fibers—coarse opening—fine opening—carding—spray coating a phase change material—pre-drying—cross lapping—spray coating a glue on both the surfaces—drying reinforcement—cutting and winding.

According to an aspect of the present invention, a fluffy temperature regulating warmth retention material produced in accordance with the present invention may be provided. The fluffy temperature regulating warmth retention material comprises multiple single web layers lapped layer by layer, wherein the surfaces of at least part of the multiple single web layers are spray coated with a phase change material, such as several certain layers (for example, several middle layers), or every alternate layer, or each layer, or any selected layer or layers of the single web, depending on the needs.

The fluffy temperature regulating warmth retention material produced in accordance with the method of the present invention comprises a low melting point fiber which can thus be adhered to different fibers, such that the single web has a certain strength. Suitable ratios of the fibers are: low melting point fiber: 6-20%; additional fiber: 80-94%. The gauge of the low melting point fiber may be 1.5 D-7 D with a length of 38 to 64 mm. The low melting point fiber material may be selected from one of a terylene low melting point fiber, a polypropylene low melting point fiber or a polyethylene low melting point fiber. The low melting point fiber structure may be selected from a synthetic fiber skin-core structure, or a parallel structure, or the like, such as Huvis 2080, ES fiber and the like that are commercially available.

The additional fiber included in the fluffy temperature regulating warmth retention material produced in accordance with the method of the present invention may comprise a natural fiber, such as cotton, wool, and the like; or a synthetic fiber, such as a terylene fiber, a polypropylene fiber, an acrylic fiber, and the like; or a regenerated fibers such as a viscose fiber, and the like. Any one of the listed fiber may be used alone, or a mixture of two or more fibers from the same type or different types may be used. The gauge of the employed natural fiber, synthetic fiber or regenerated fiber may be 0.7 D to 10 D and with a length of 10 mm to 80 mm. Preferably, the fluffy temperature regulating warmth retention material comprises a hollow three dimensional crimped fiber having a gauge of 0.7 D to 10 D and with a length of 10 mm to 80 mm. For example, commercially available ones are, Yizheng 3D hollow three dimensional crimped silica-containing fiber, Yuanfang 2D solid silica-free fiber, and the like. The hollow fibers included in the *flocculus* are helpful in keeping the *flocculus* fluffy.

Where the fluffy temperature regulating warmth retention material produced in accordance with the method of the present invention is used in a garment or a bedding article application, the appropriate phase change temperature is generally between 15° C. to 35° C., and the suitable phase change material may be a phase change microcapsule having a net content of 10% to 55% of the total weight of the temperature regulating warmth retention material, or preferably, 25% to 50%, which is better. In this invention, the wall material of the phase change microcapsule included in temperature regulating warmth retention material may be selected from one of a polyethylene polymer, an alkyl polyacrylic polymer or a polyurethane polymer, and the like, and the core material of the same may be a paraffin, an n-alkane compound, a halogenated n-alkane compound, or an aliphatic ester, or a mixture of several of them.

The fluffy temperature regulating warmth retention material produced in accordance with the method of the present invention may be subjected to a glue spray coating treatment and in this way, the outer surfaces of the material may be spray coated with a glue. Preferably, the solid content of the glue, i.e. the dry weight of the glue per square meter *flocculus* is in a range of 2 gsm to 15 gsm, and more preferably, 4 gsm to 10 gsm. Suitable glues comprise one of acrylics or epoxy resins or EVAs, such as for example, 201 mid-soft (produced by Quansong, Yixing), EXP3267 (Rohm and Haas), among others, which are commercially available.

Example 1

2 kg of 2 D*51 mm terylene low melting point fibers (Huvis 2080, produced by Huvis Corporation) were used.

The additional fibers were 5 kg of 2 D*51 mm solid fibers (SN-8250S, produced by Yuanfang Corporation) and 3 kg of 3 D*64 mm hollow crimping fibers (YZK4133D hollow fiber, produced by Yizheng Corporation). After being processed by mixing—coarse opening—fine opening—feeding—carding, a single web 10 was obtained. Then, a phase change material, i.e. a phase change microcapsule emulsion having a core material of an n-alkane (n-octadecane) produced by Shenzhen Yingbao Corporation was spray coated consecutively and the amount of spray was controlled such that the net content of the phase change microcapsules 20 is 55% of the total weight of the single web 10, and then pre-dried at 80° C. for 5 seconds, and then the single web 10 was cross lapped layer by layer to form a *flocculus*. When subjected to a heat setting reinforcement, the outer surfaces of the *flocculus* as formed were spray coated with a glue and dried, wherein EXP3267 acrylic copolymer emulsion glue (Rohm and Haas) was used and the amount of spray was controlled such that the solid content of the spray coated glue was 4 gsm. Then the resulting *flocculus* was dried at 135° C. for 12 minutes to form a structure having the phase change microcapsules disposed on each single web layer 10 of the temperature regulating warmth retention material, as illustrated in FIG. 1.

Example 2

Figure 2:
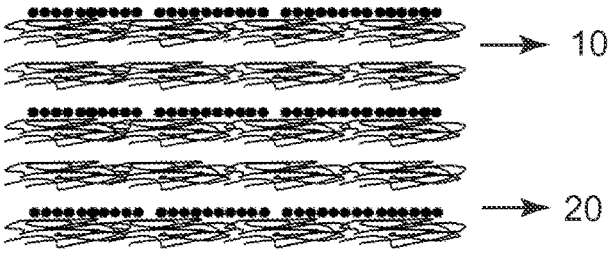
FIG. 2 is schematic diagram of the fluffy temperature regulating warmth retention material produced in accordance to the second Example of the method of the present invention.

1.5 kg of 2 D*51 mm low melting point fibers (130° C.) (ES polyethylene/polypropylene fiber, produced by Guangzhou ES Fiber Co., Ltd) were used. The additional fibers were 2 kg of natural fiber—cotton, 3 kg of 2 D*51 mm synthetic fibers—solid silica-containing fibers (SN-8250S2D fiber, produced by Yuanfang Corporation) and 3.5 kg of 7 D*64 mm hollow crimping fibers (YZK61A7D hollow fiber, produced by Yizheng Corporation). After being processed by mixing—coarse opening—fine opening—feeding—carding, a single web 10 was obtained. The output speed, lapping speed and the time required for lapping one single web 10 layer were controlled, and an emulsion containing phase change microcapsules 20 was spray coated intermittently at a time interval such that, after cross lapping, one layer of the phase change microcapsules 20 was provided on every two single web 10 layers. MG26 phase change microcapsule emulsion with paraffin cores (produced by Beijing Guangyu Phase Transformation Technology Co., Ltd) was used, and the amount of spray was controlled such that the net content of the phase change microcapsules 20 is 32% of the total weight of two single web 10 layers or the *flocculus*, and then pre-dried at 70° C. for 10 seconds, and then the single web 10 were cross lapped layer by layer to form a *flocculus*. When subjected to a heat setting reinforcement, the outer surfaces of the *flocculus* as formed were spray coated with a glue and dried, wherein the glue is a polyvinyl acetate emulsion (VAE 707 product, produced by Beijing Zhonghui United Company) and the amount of spray was controlled such that the solid content of the spray coated glue was 10 gsm. Then the resulting *flocculus* was dried at 140° C. for 10 minutes to form a temperature regulating warmth retention material with one phase change microcapsule layer 20 provided on every two single web layers 10, as illustrated in FIG. 2.

Example 3

Figure 3:
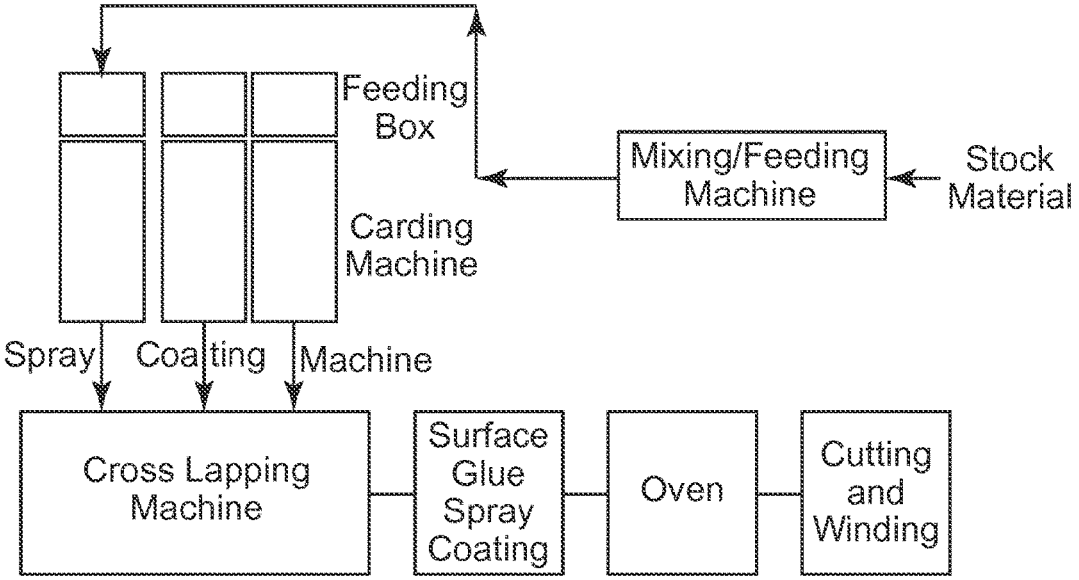
FIG. 3 is a schematic diagram of the third Example in accordance with the method of the present invention.
Figure 4:
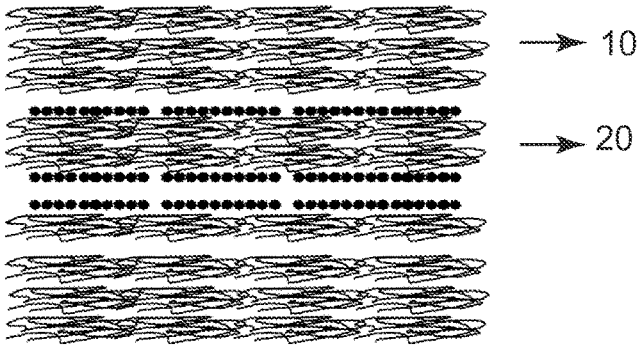
FIG. 4 is a schematic diagram of the fluffy temperature regulating warmth retention material produced in accordance to the third Example of the method of the present invention.

0.6 kg of 4 D*51 mm terylene low melting point fibers (4080, produced by Huvis Corporation) were used. The additional fibers were 5.9 kg of 2 D*51 mm solid viscose regenerated fibers (32S viscose fiber, manufactured by Lenzing Corporation) and 3.5 kg of 7 D*64 mm hollow crimping synthetic fibers (YZK61A7D hollow fiber, produced by Yizheng Corporation). After being processed by mixing—coarse opening—fine opening—feeding—carding, a single web 10 was obtained. Then, as illustrated in FIG. 3, three carding machines were put into operation simultaneously to obtain three identical single webs 10. Only the single web 10 obtained from the middle carding machine of FIG. 3 was spray coated consecutively with an emulsion containing a phase change microcapsules 20. A phase change microcapsule emulsion with aliphatic ester cores (produced by Hangtian Haiying (Zhenjiang) Special Materials Co., Ltd) was used, and the amount of spray was controlled such that the net content of the phase change microcapsules 20 is 15% of the total weight of the *flocculus*, and then pre-dried at 60° C. for 15 seconds, and then the three single webs 10 were cross lapped using three cross lapping machines, and combined and formed as a *flocculus* and the single web 10 spray coated with the phase change microcapsules 20 was disposed in the central portion of the *flocculus*. After the cross lapping was completed, a heat setting reinforcement was performed. The outer surfaces of the *flocculus* as formed were spray coated with a glue and dried, wherein the glue was vinyl acetate-acrylic emulsion (YH-1 glue product, produced by Yixing Jindeli Chemicals Company) and the amount of spray was that the solid content of the glue was 6 gsm. Then the resulting *flocculus* was dried at 145° C. for 8 minutes to obtain a temperature regulating warmth retention material having the structure as illustrated in FIG. 4.

For the purpose of evaluating the materials produced in accordance with the present invention, a common warmth material, i.e. a control sample for comparison with the samples of Examples 1 to 3, was produced in accordance with the process and fibers of Example 2, but the spray coating of a phase change material and the pre-drying were not included. The test results of the properties of the samples are as below:

TABLE 1

| Properties as measured | | | | | | |
|---|---|---|---|---|---|---|
| Sample | PCM % | Glue/ gsm | Thickness/ cm | Weight-Prior to Wash/g | Weight-After 5 Washes with Water/g | Weight Retention Rate/% |
| Example 1 | 55 | 4 | 1.46 | 55.29 | 54.02 | 97.7 |
| Example 2 | 32 | 10 | 1.48 | 48.41 | 48 | 99.2 |
| Example 3 | 15 | 6 | 1.5 | 37.76 | 37.23 | 98.6 |
| Control | 0 | 6 | 1.41 | 32.55 | 32.5 | 99.8 |

It can be seen from the above Table 1 that, compared with the control sample, the samples of the Examples of the present invention do not have substantial change in thickness, and the process does not result in decrease in filling power, which maintains, to the full extent, or is close to, the original filling power and soft hand feeling where no phase change material is incorporated. The weight retention rate after five washes with water may be up to 97% to 99%, indicating no substantial loss of the phase change material.

Accordingly, the method of the present invention provides a fluffy temperature regulating warmth retention material that can use more phase change material and have it dispersed in the volume of the warmth material to achieve a good temperature regulating performance and avoid the employment of dipping, drawing, hydroentangling, needle punching, which would affect the filling power, thereby retaining the filling power of the temperature regulating warmth retention material and meanwhile, the material has a good hand feeling and a good wash resistance.

Although the present invention has been described as above in combination with the Examples, it is merely for clarity of the description but not for limiting. The scope of the present invention would rather be defined by the claims.

What is claimed is:

1. A method for producing a fluffy temperature regulating warmth retention material, comprising: selecting a low melting point fiber and an additional fiber, carding them to form a single web, spray coating a phase change material along at least a portion of the length of a surface of the single web, lapping the single web layer by layer, and performing heat setting reinforcement to form the warmth retention material.

2. The method according to claim 1, wherein the low melting point fiber is 6% to 20% by weight of the total fiber.

3. The method according to claim 1, wherein the low melting point fiber is selected from a terylene low melting point fiber, a polypropylene low melting point fiber or a polyethylene low melting point fiber.

4. The method according to claim 1, wherein the low melting point fiber is selected from one of a skin-core type low melting point fiber, or a parallel type low melting point fiber.

5. The method according to claim 1, wherein the additional fiber is selected from one or more of a natural fiber, a synthetic fiber, or a regenerated fiber.

6. The method according to claim 1, wherein the phase change material has a net content of 10% to 55% of the total weight of the temperature regulating warmth retention material.

7. The method according to claim 1, wherein the phase change material is spray coated at an interval of the same distance or at an interval of different distances along the length direction of the surface of the single web.

8. The method according to claim 1, wherein the phase change material is spray coated along the length of the surface of the single web in a consecutive manner.

9. The method according to claim 1, comprising a step of pre-drying the single web after the phase change material is spray coated along at least part of the length of the surface of the single web.

10. The method according to claim 9, wherein the pre-drying is performed at a temperature of 60° C. to 80° C. for 5 to 15 seconds.

11. The method according to claim 1, wherein the single web is lapped layer by layer by cross lapping.

12. The method according to claim 11, wherein at least two single webs which are not spray coated with the phase change material are lapped layer by layer with at least one single web which is spray coated with the phase change material, and the single web which is spray coated with the phase change material is placed in the middle.

13. The method according to claim 1, wherein the heat setting reinforcement comprises performing a step of spray coating a glue on the outer surfaces of a *flocculus* formed by lapping layer by layer of the single web, and drying the same.

14. The method according to claim 13, wherein the glue selected from one of an acrylic copolymer emulsion, a polyvinyl acetate emulsion, and a vinyl acetate-acrylic copolymer emulsion is used in the spray coating step, and the solid content of the spray coated glue is 2 gsm to 15 gsm.

15. A fluffy temperature regulating warmth retention material produced according to the method of claim 1, comprising multiple single web layers which are lapped layer by layer, wherein the surfaces of at least part of the multiple single web layers are spray coated with a phase change material, and the fiber of the at least part of the multiple single web layers comprises a low melting point fiber and an additional fiber.

16. The fluffy warmth retention material according to claim 15, wherein the low melting point fiber is of a gauge in a range of 1.5 D to 7 D.

17. The fluffy warmth retention material according to claim 15, wherein the phase change material is a phase change microcapsule, and the core material of the phase change microcapsule is selected from one of a paraffin, an n-alkane compound, a halogenated n-alkane compound or an aliphatic ester, or a mixture of several of them.

18. The fluffy warmth retention material according to claim 15, wherein the phase change material is spray coated on the surface of each of the single web layers.

19. The fluffy warmth retention material according to claim 15, wherein the phase change material is spray coated on the surface of every two single web layers.

20. The fluffy warmth retention material according to claim 15, wherein the phase change material is spray coated on the surfaces of the single web layers in the middle portion.

* * * * *